US010934800B2

(12) United States Patent
Hatten

(10) Patent No.: US 10,934,800 B2
(45) Date of Patent: Mar. 2, 2021

(54) ROTATING HANGER RUNNING TOOL

(71) Applicant: Weatherford Technology Holdings, LLC, Houston, TX (US)

(72) Inventor: Adam J Hatten, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 16/528,214

(22) Filed: Jul. 31, 2019

(65) Prior Publication Data

US 2021/0032952 A1 Feb. 4, 2021

(51) Int. Cl.
*E21B 33/04* (2006.01)

(52) U.S. Cl.
CPC ..... *E21B 33/04* (2013.01); *E21B 2200/01* (2020.05)

(58) Field of Classification Search
CPC ..... E21B 33/04; E21B 2200/01
See application file for complete search history.

(56) References Cited

U.S. PATENT DOCUMENTS 3,528,686 A * 9/1970 Nelson ..... E21B 33/0415 285/18
3,628,604 A 12/1971 Childers et al.
3,777,819 A 12/1973 Delano
3,901,546 A * 8/1975 Piazza ..... E21B 33/04 294/86.15
4,611,663 A 9/1986 Goris et al.
4,674,576 A 6/1987 Goris et al.
4,969,516 A 11/1990 Henderson et al.
5,181,570 A 1/1993 Allwin et al.
5,439,061 A * 8/1995 Brammer ..... E21B 33/043 166/368
5,725,056 A * 3/1998 Thomson ..... E21B 33/03 166/208
6,065,536 A 5/2000 Gudmestad et al.
7,926,590 B2 4/2011 Eriksen et al.
8,276,671 B2 10/2012 Neto et al.
8,286,711 B2 10/2012 Neto et al.
8,347,966 B2 1/2013 Nguyen et al.
8,408,309 B2 4/2013 Eppinghaus et al.
8,528,650 B1 9/2013 Smith et al.
8,851,182 B2 10/2014 Nguyen et al.
8,936,092 B2 1/2015 Nguyen et al.
9,027,658 B2 5/2015 Bories et al.
9,580,980 B2 2/2017 Hartley et al.
9,598,928 B2 3/2017 Thornburrow et al.
(Continued)

OTHER PUBLICATIONS

"Rotating Mandrel Casing Hanger," Cameron, 2016, 1 page.

*Primary Examiner* — James G Sayre
(74) *Attorney, Agent, or Firm* — Blank Rome LLP

(57) ABSTRACT

A running tool runs a hanger and tubing string into a wellbore. A tool body threads onto the hanger. Lugs are held on the body with catches. During the threading, triggers engage with the hanger and release the catches, and springs bias the lugs to an extended condition. Being extended, the lugs can engage in slots in the hanger, such as flutes in the hanger's flange. The engagement of the lugs with the slots prevents further threading of the tool on the hanger while the threads keep the tool connected to the hanger. The tubing string can be rotated and moved axially during cementing to distribute the cement evenly. Once done, the lugs can ratchet out of the slots as the tool is unthreaded from the hanger.

20 Claims, 6 Drawing Sheets

(56) References Cited

U.S. PATENT DOCUMENTS

| | | | | |
|---|---|---|---|---|
| 9,689,229 | B2 | 6/2017 | Hanson et al. | |
| 9,863,205 | B2 | 1/2018 | Levert, Jr. et al. | |
| 9,909,385 | B2 * | 3/2018 | Cocker, III | E21B 33/14 |
| 10,233,710 | B2 | 3/2019 | Nguyen | |
| 10,233,712 | B2 | 3/2019 | Nguyen et al. | |
| 10,323,480 | B2 | 6/2019 | Cocker, III et al. | |
| 10,392,883 | B2 | 8/2019 | Thornburrow et al. | |
| 2002/0062957 | A1 * | 5/2002 | Reilly | E21B 33/04 166/75.14 |
| 2010/0326674 | A1 | 12/2010 | Nguyen et al. | |
| 2014/0311753 | A1 | 10/2014 | Hanson et al. | |
| 2017/0016294 | A1 * | 1/2017 | Thornburrow | E21B 33/0415 |
| 2017/0152721 | A1 | 6/2017 | Bories et al. | |
| 2017/0167218 | A1 * | 6/2017 | Cheah | E21B 23/02 |
| 2018/0179839 | A1 | 6/2018 | Nguyen | |
| 2018/0258727 | A1 * | 9/2018 | Lim | E21B 33/04 |

* cited by examiner

ROTATING HANGER RUNNING TOOL

BACKGROUND OF THE DISCLOSURE

Casing is run and cemented in a wellbore to line the borehole. The casing can extend from a casing hanger landed in a casing head of a wellhead. In some completions, casing in the form of a liner may also be installed in the wellbore and hung from a liner hanger in an existing casing string. The liner can be cemented in the wellbore, and operations may then install a tieback string of casing that extends from the wellhead downward into engagement with the liner hanger.

During cementing operations, cement is pumped down the bore of the hanger and the extending tubing string. While the cement is pumped, it is desirable to ensure that the cement is pushed to the annulus without creating voids or pockets of trapped air. Historically, the hanger and tubing string have been reciprocated up and down during cementing with a running tool to help avoid creating voids or pockets. Unfortunately, rotation of the tubing string by the running tool may not be performed or may be limited in application during cementing. In particular, rotation of the tubing string to the right may apply too much torque to the threaded connection of the running tool to the hanger. Rotation of the running string to the left may back-off or unthread the connection.

The subject matter of the present disclosure is directed to overcoming, or at least reducing the effects of, one or more of the problems set forth above.

SUMMARY OF THE DISCLOSURE

As disclosed herein, a tool is used for running a hanger and a tubing string in a wellbore. The hanger has upper and lower ends and defines a first bore therethrough. The lower end is connected to the tubing string, while the upper end has first thread disposed thereabout. The hanger defines at least one first slot. The tool comprises a tool body, at least one lug, at least one trigger, and at least one biasing element.

The tool body has first and second ends and defines a second bore therethrough. The second bore defines second thread thereabout, which is configured to thread onto the first thread in a first direction.

The at least one lug is disposed on the tool body and has a catch. The at least one trigger disposed in the tool body is movable between first and second conditions. The at least one trigger in the first condition is engaged with the catch and is engageable with the hanger. The at least one trigger in the second condition releases the catch. The at least one biasing element biases the at least one lug released from the catch toward an extended condition. The at least one lug in the extended condition is engageable with the at least one slot in the hanger.

The at least one lug can comprise a first shoulder and a second shoulder, the first shoulder being engageable in the first direction with a first side of the at least one slot, the second shoulder being ratchetable along the second side of the at least one slot.

The second thread of the body can thread in the first direction onto the first thread of the hanger and can unthread in a second, opposite direction from the first thread.

The at least one lug can comprise a distal end. In the extended condition, the distal end can extend beyond the second end of the hanger and can be engageable with the at least one slot in a flange disposed externally about the casing hanger.

The at least one trigger can comprise a first portion and a second portion. The first portion can be exposed internally to the second bore through a port in a side of the body, and the first portion can be engageable with the hanger. The second portion can be engageable with the catch and can be releasable therefrom in response to the engagement of the first portion with the hanger.

The catch can comprise a first surface disposed on the at least one lug. The second portion of the at least one trigger can therefore comprise a second surface opposite to the first surface. The first surface with the at least one trigger in the first condition disposed can be in opposed relation to the second surface. Meanwhile, the first surface with the at least one trigger disposed in the second condition can be in unopposed relation to the second surface.

The at least one trigger can comprise: a button having the first and second portions and disposed in a pocket of the body; and a spring disposed between the button and the body and biasing the first portion toward the second bore through the port in the side of the body.

The first portion of the button can comprise a pin disposed in the port in the side of the body.

The at least one biasing element can comprise a compression spring disposed between a shoulder of the body and a proximal end of the at least one lug.

The tool body can define at least one pocket outside the tool body, where the at least one pocket has the at least one lug recessed therein.

The at least one lug can define a channel along the at least one lug. For its part, the tool body can comprise a retainer disposed in the channel and retaining the at least one lug in the at least one pocket.

The tool body can comprise a first material, whereas the at least one lug can comprise a second material different from the first material.

According to the present disclosure, an apparatus is run on a running string for cementing a tubing string in a wellbore. The apparatus comprises a hanger and a running tool. The hanger has upper and lower ends and define a first bore therethrough. The lower end is connected to the tubing string. The upper end has first thread disposed thereabout, and the hanger defines at least one first slot. The running tool can be comparable to that described above.

A method according to the present disclosure is directed to running a tubing string and a hanger in a wellbore. The method comprises: threading a second thread on the running tool in a first direction on first thread of the hanger; engaging, during the threading, at least one trigger in the running tool on a portion of the hanger; releasing at least one catch in response to the engagement of the at least one trigger; shifting at least one lug from a retracted condition to an extended condition on the running tool in response to the release of the at least one catch; and engaging the at least one shifted lug in the first direction in at least one slot on the hanger.

The method can further comprise: unthreading the second thread in a second, opposite direction off of the first thread of the hanger; and ratcheting, during the unthreading, the at least one lug out of the at least one slot on the second hanger.

The method can further comprise: moving the tubing string axially in the wellbore with the running tool; and rotating the tubing string radially in the first direction in the wellbore with the running tool.

To engage, during the threading, the at least one trigger in the running tool on the hanger, the method can comprise engaging an internal portion of the at least one trigger exposed in a bore of the running tool on the hanger.

To release the at least one catch in response to the engagement of the at least one trigger, the method can comprise shifting a second portion of the at least one trigger away from the catch in response to the engagement with the internal portion.

To shift the at least one lug from the retracted condition to the extended condition on the running tool in response to the release of the at least one catch, the method can comprise biasing the at least one lug to the extended condition with a distal end of the at least one lug extending beyond an edge of the running tool.

To engage the at least one shifted lug in the first direction in the at least one slot on the hanger, the method can comprise stopping a second edge of the at least one shifted lug against a first edge of the at least one slot.

The foregoing summary is not intended to summarize each potential embodiment or every aspect of the present disclosure.

DETAILED DESCRIPTION OF THE DISCLOSURE

Figure 1C:
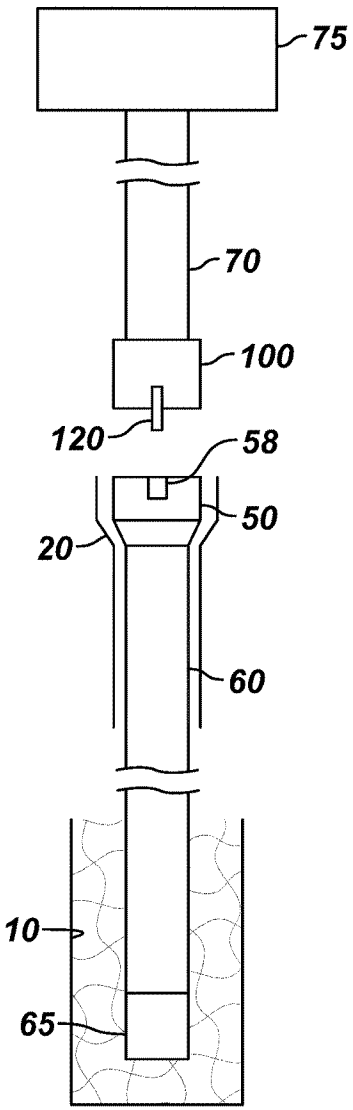
FIGS. 1A-1C illustrate a running tool connected to a hanger on a tubing string being manipulated in a wellbore.
Figure 1B:
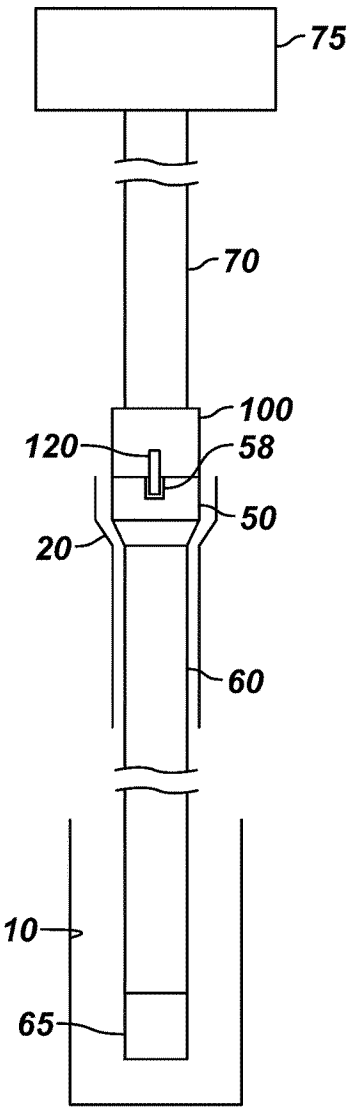
Figure 1A:
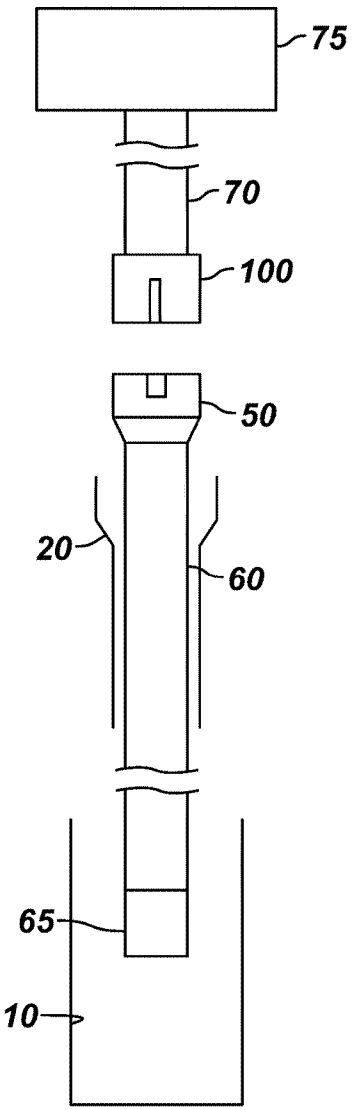

FIGS. 1A-1C illustrate a running tool 100 connected to a hanger 50 on a tubing string 60 being manipulated in a wellbore 10. As shown in FIG. 1A, the running tool 100 is disposed on a running string 70, and the running tool 100 is connected to the hanger 50 on the tubing string 60. The running tool 100 is used for manipulating the tubing string 60 in the wellbore 10 by running the tubing string 60 into the wellbore 10 and landing the hanger 50 on a well component 20, such as a casing head, a liner hanger, or the like.

A cementing operation can then cement the tubing string 60 in the wellbore 10. To help distribute the cement during the operation, the running tool 100 and string 70 can move the hanger 50 and the tubing string 60 axially by raising and lowering them together. Additionally, the running tool 100 and string 70 can turn the hanger 50 and string 60 rotationally (i.e., clockwise) by rotating them together at the same time without over-torqueing the running threads.

For example, the tubing string 60 may be casing that extends from a mandrel-style casing hanger 50 for landing in a casing head 20 of a wellhead. The casing string 60 can be run into the wellbore 10 and cemented in place. To facilitate the cementing operation, the running tool 100 can raise, lower, and rotate the casing string 60. After cementing, the running tool 100 can then be removed, and additional components, pack-offs, etc. can be installed at the wellhead.

In particular, the casing string 60 may be run into the wellbore 10 with a cement shoe 65 having a check valve attached to the downhole end of the casing string 60. The casing hanger 50 may already be connected to the casing string 60, or the running tool 100 connected with the hanger 50 may be made up onto the casing string 60. The running tool 100, the casing head 50, and the casing string 60 are then run through the wellhead with the running string 70 to land the hanger 50 on a landing shoulder in the casing head 20 or other well component in a conventional manner so the hanger 50 can support the casing string 60 suspended in the wellbore 10.

To cement the casing string 60 in place in the wellbore 10, a bottom plug (not shown) is launched down the casing string 60 followed by a cement slurry pumped down the casing string 60. The cement slurry is followed by a top wiper plug (not shown). The bottom plug reaches a landing collar in the cement shoe 65, and a rupture disk is breached so the cement slurry can pass through the bottom plug and into the annulus of the wellbore 10. The top wiper plug is pumped down the tubing string 60 with a displacement fluid, and the cement slurry flows out of the cement shoe 65 and up the annular space around the casing string 60. The cement shoe 65 prevents backflow of cement back into the casing string 60.

At the conclusion of the operation, the operator can then release the running tool 100 from the casing hanger 50 and can retrieve the running string 70 and the tool 100 for additional completion operations to be performed.

In another example, the tubing string 60 may be a liner that extends from a liner hanger 50 for landing in a tubing head 20 on existing casing string. The liner 60 can be cemented in the wellbore 10 in much the same way discussed above. In particular, the liner 60 may have a cement shoe 65 with a check valve attached to the downhole end of the liner 60. When the liner 60 is run downhole to the desired depth, a liner top packer (not shown) is incorporated with a mandrel-style liner hanger 50 on the uphole end of the liner 60. The running tool 100 is attached to the liner hanger 50. The operator then runs the liner 60 into the wellbore 10 on the running string 70 attached to the running tool 100. The operator sets the liner hanger 50 and pumps cement through the running string 70, down the liner 60, and back up the annulus surrounding the liner 60.

A wiper plug (not shown) following the cement is run down the running string 70 to wipe cement from the interior of the liner 60 at the conclusion of the cement pumping. The operator then sets the liner top packer, if used, releases the running tool 100 from the liner hanger 50, and retrieves the running string 70 and tool 100. The operator may then install a tieback string (not shown) of casing that extends from the wellhead downward into engagement with the liner hanger 50.

To help distribute the cement slurry uniformly and avoid creating voids or pockets in the cement during the cementing operations, such as described above, the tubing string 60 is reciprocated and rotated during the cementing operation. As will be appreciated, various mechanisms, such as a top drive 75, may be used to reciprocate and rotate the hanger 50 and the casing string 60 in the wellbore 10. To transfer the motion of the running string 70 to the hanger 50 and its connected tubing string 60, the running tool 100 threads onto the hanger 50 for the axial connection and has lugs 120 that engage the hanger 50 to prevent over-torqueing the threads during the rotation.

For the running tool 100 to thread onto the hanger 50, the lugs 120 are initially kept retracted until sufficient make up is made between the running tool 100 and the hanger 50. Triggers in the form of latching pin assemblies positioned on the running tool 100 engage portion of the mandrel hanger 50 and release the lugs 120 during make up. The lugs 120 then extend and engage in slots or flutes 58 of the mandrel hanger 50. When the lugs 120 are received within these slots 58, rotation of the running tool 100 causes the lugs 120 to push against sides of the slots 58 to drive rotation of the casing hanger 50. In this way, the lugs 120 transfer rotation of the running string 70 to the hanger 50 and its connected tubing string 60 without over-torqueing the running threads between the tool 100 and the hanger 50.

Figure 2A:
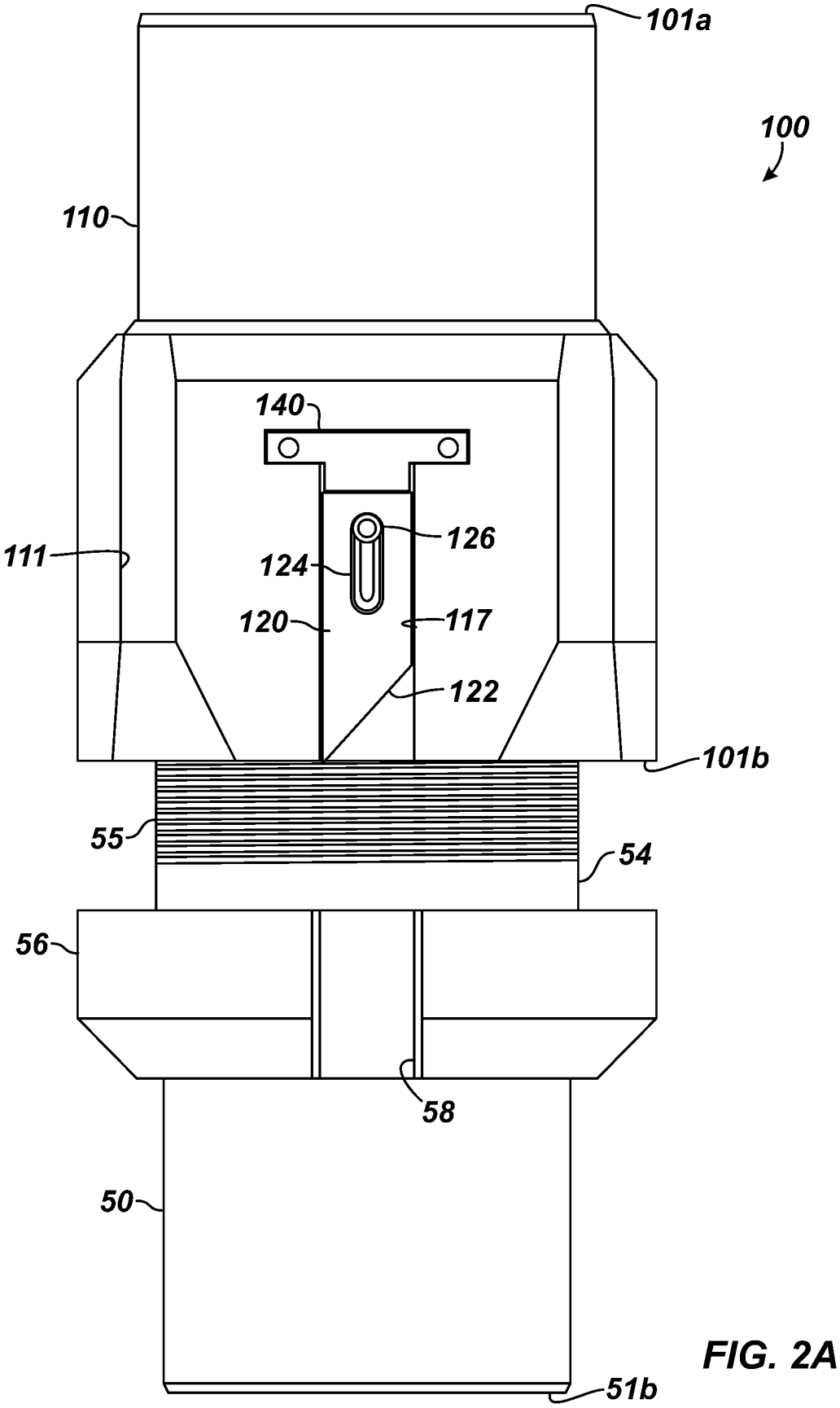
FIG. 2A illustrates an elevational view of a running tool being connected to a hanger for a tubing string.
Figure 2B:
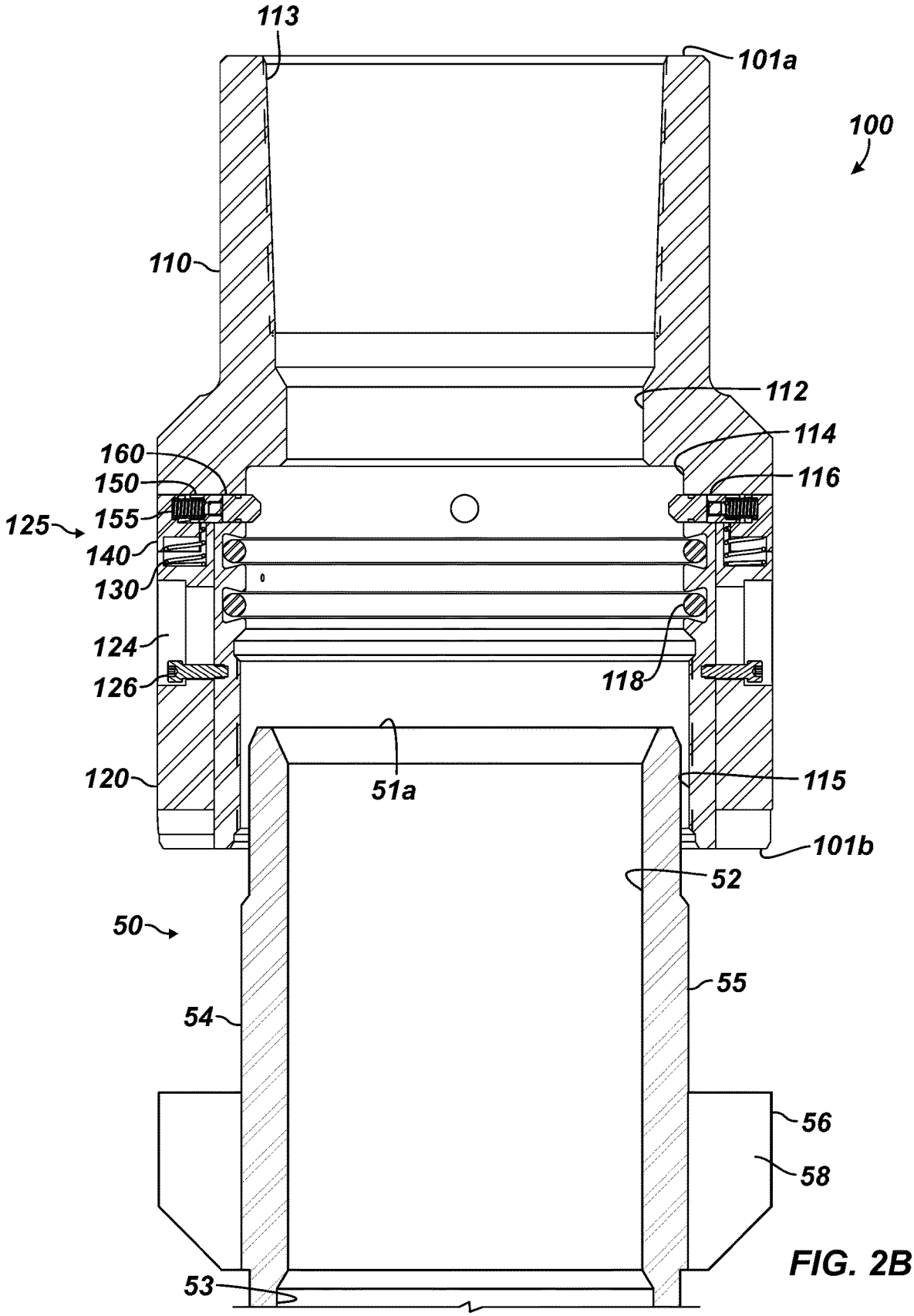
FIG. 2B illustrates a cross-sectional view of the running tool being connected to the hanger.
Figure 3A:
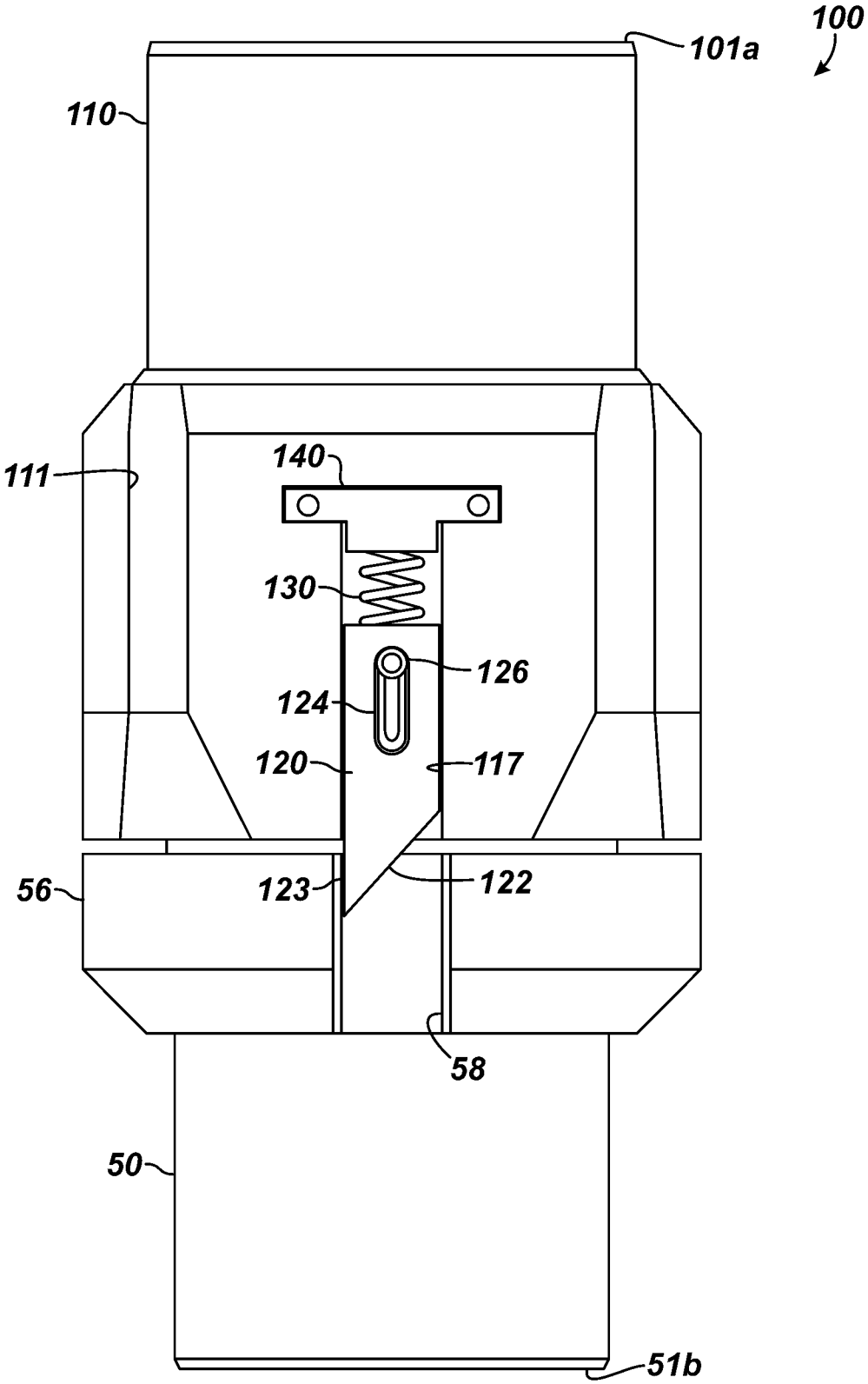
FIG. 3A illustrates an elevational view of the running tool connected to the hanger.
Figure 3B:
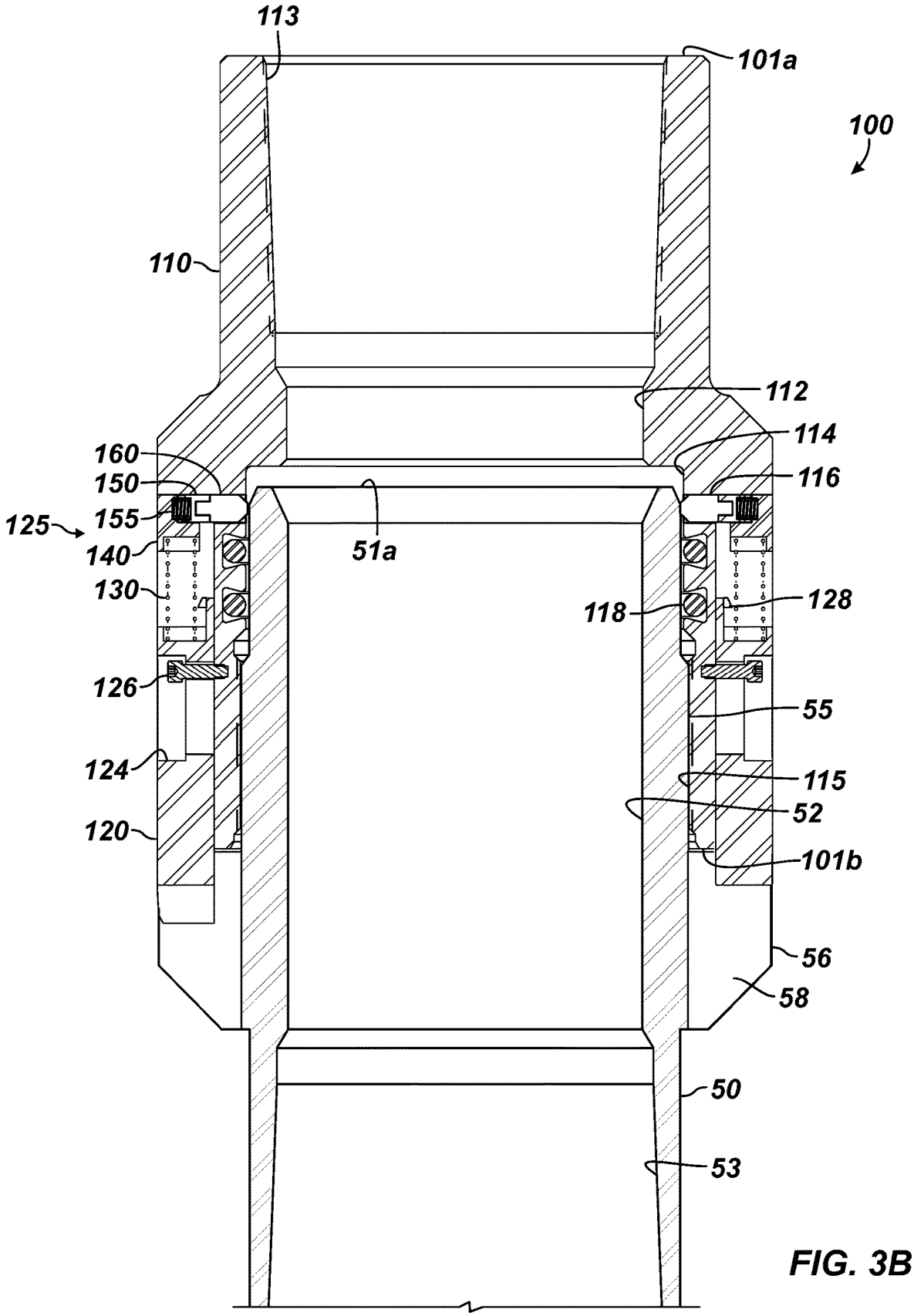
FIG. 3B illustrates a cross-sectional view of the running tool connected to the hanger.

Turning now to details of the running tool 100, reference is made to FIGS. 2A-2B, which show elevational and cross-sectional views of a running tool 100 of the present disclosure being connected to a tubing hanger 50. Reference is also made to FIGS. 3A-3B, which show elevational and cross-sectional views of the running tool 100 connected to the tubing hanger 50.

The tubing hanger 50 has upper and lower ends 51*a-b* and defines a first bore 52 therethrough. The lower end 51*b* is connected to a tubing string (60) that is run in the wellbore to be landed and cemented in place. For example, the lower end 51*b* can include a box end (53, FIG. 2B) for connecting to a pin end (not shown) of the tubing string (60). The upper end 51*a* of the casing hanger 50 has a neck 54 with first (external) thread 55 disposed thereabout.

A flange 56 is disposed externally about the tubing hanger 50. The hanger 50 includes at least one slot 58 in its landing flange 56. In at least some instances, the at least one slot 58 can be defined fully through the flange 56 to form a flute to facilitate the flow of fluid (e.g., drilling mud) past the exterior of the hanger 50 when installed.

Such flutes 58 can be customary for tubing hangers 50. Should flutes 58 not be necessary for fluid communication on a flange 56 of the hanger 50, then slots, pockets, partial cutaways, or the like 58 can be formed and used on the flange 56. Preferably, the flange 56 has two or more of the flutes or slots 58, and the number of lugs 120 on the running tool 100 can match the number of flutes 58. As noted previously, the slots 58 on the hanger 50 receive extended lugs 120 of the running tool 100 so that the engaged slots 58 and lugs 120 cooperate to transmit torque between the running tool 100 and the hanger 50 when the running tool 100 is coupled to the hanger 50 as shown in FIGS. 3A-3B.

The running tool 100 and has upper and lower ends 101*a-b* and has a tool body 110 with a second bore 112 defined therethrough. The upper end 101*a* is connected to a running string (70). For example, the tool body 110 has a box end (113, FIG. 2B) that connects to a pin end (not shown) of the running string (70). The lower end 101*b* connects to the tubing hanger 50, as described below.

The running tool 100 can connect to the hanger 50 in any suitable manner. For example, the second bore 112 defines a receiver 114 with second (internal) thread 115 thereabout configured to thread onto the hanger's external thread 55. The second thread 115 of the body 110 threads in a first direction onto the first thread 55 of the casing hanger 110 and unthreads in a second, opposite direction from the first thread 55. In this example, the threads 55, 115 are right-handed threads for clockwise threading. However, the threads 55, 115 can instead be left-handed threads in other arrangements, in which case certain features of the lugs 120 would be reversed.

As noted briefly above, the tool 100 has at least one of the lugs 120 and has at least one of the triggers 125 controlling extension of the at least one lug 120. Preferably, two or more of the lugs 120 are used to match the slots 58 in the hanger's flange 56. Should any given lug 120 fail to be released by the trigger 125, then any redundant lug 120 that has been released will provide the desired stop of the threading. The tool body 110 may also have flutes 111 in its outer surface for passage of fluid and the like.

As shown, the lugs 120 can be disposed externally on the tool body 110. As shown in FIGS. 2A and 3A, for example, the lugs 120 can be recessed in longitudinal pockets 117 on the outside of the body 110. Other configurations are possible in which the lugs 120 are housed in the tool body 110 or are covered by a sleeve or the like.

The tool body 110 is composed of a first material, such as a suitable steel material or alloy. However, the lugs 120 can be composed of a different material, such as a friction reducing material used for bearings to facilitate the movement of the lugs 120 in the pockets 117 of the body 110. The pin 160 of the trigger 125 can also be composed of this different, friction reducing material, to facilitate its engagement with the hanger 50. Moreover, an O-rings or other seals can be used between the pins 160 and the ports 116 to seal off any fluid communication.

Each of the lugs 120 has a catch 128. Each of the lugs 120 also includes one of the triggers 125 disposed in the body 110. Each trigger 125 is movable between first and second conditions to control the extension of the respective lug 120. In general, the trigger 125 in the first condition is engaged with the catch 128 of the respective lug 120 and is engageable with the hanger 50. As described below, the trigger 125 is moved to the second condition by the engagement, thereby releasing the catch 128.

Each of the lugs 120 includes a biasing element or compression spring 130 biasing the respective lug 120 released from the catch 128 toward an extended condition. To hold the lugs 120 to the tool body 110, each of the lugs 120 defines a longitudinal channel 124 along the lug 120. A retainer or screw 126 is disposed in the channel 124 and retains the lug 120 to the body 110.

As shown in FIGS. 3A-3B, the running tool 100 threads with its internal thread 115 onto the external thread 55 of the hanger's neck 54. O-rings or other seals 118 in the tool's receiver 114 can seal with the neck 54. Because the lugs 120 are initially in the pockets 117 during threading, they are eventually released by the triggers 125 as described below to thereby engage the flange 56.

As shown in FIGS. 3A-3B, the distal end of the lug 120 in the extended condition extends beyond the lower end of the body 110 and is engageable with the slot 58 in the flange 56. As best shown in FIG. 3B, the distal ends of the lugs 120 each has a first shoulder 123 along a first (clock) edge and has a chamfer or taper 122 along a second (counter) edge. The first shoulder 123 is engageable in a first direction with a first side of the flange slot 58. The chamfer or taper 122 is ratchetable in a second, opposite direction along the second side of the flange slot 58.

For example, the tubing string 60 can be rotated to the right, or clockwise when viewed from the top of the running tool 100, while running the hanger 50 and after landing as desired. The clock edges 123 of the lugs 120 engage with the clock edges of the slots 58 of the hanger's flange 56 and transmit the torque directly from the lugs 120 to the hanger 50. This helps prevent over torqueing the threaded connection between the threads 55, 115 of the hanger 50 and running tool 100.

By contrast, the running tool 100 may be rotated to the left, or counter-clockwise when viewed from the top of tool 100, thus unscrewing the running tool 100 from the casing hanger 50. The chamfered edge 122 of the lugs 120 slide upwardly and over the counter edges of the flutes 58 in the hanger's flange 56.

As can be seen in FIGS. 2B and 3B, the trigger 125 includes an internal portion in the form of a pin 160 and includes an external portion in the form of a button 150. The pin 160 is exposed internally to the bore 112 of the body 110 through a port 116 in a side of the body 110. The pin 160 is engageable with the upper end 51*a* or another portion of the hanger 50. The button 150 is engageable with the catch 128 and is releasable therefrom in response to the engagement of the pin 160 with the upper end 51*a*.

To run the tubing string 60 in a wellbore, the running tool 100 is connected to the hanger 50 by threading the internal thread 115 on the running tool 100 in a first (clockwise) direction on external thread 55 of the hanger 50. This can be done at surface, or as explained below, threading can be achieved downhole under some circumstances. To attach the running tool 100 to the hanger 50, the lugs 120 are initially retracted up in the pockets 117 of running tool 100 and held in place with the triggers 125 and catches 128. The running tool 100 is then screwed onto the hanger 50.

While threading the components together, the triggers 125 in the running tool 100 engage on a portion of the hanger 50. The engagement is not necessarily timed to the thread 55, 115, but is rather more related to the distance or amount of threading reached. In the present example, the trigger 125 is positioned to engage the distal edge of the hanger's upper end 51*a* so that most of the threading of the internal and external threads 55, 115 is achieved before the triggering. In response to the engagement of the triggers 125, the trigger 125 releases from the catch 128 of the lugs 120, and the lugs 120 shift from the retracted condition to the extended condition on the running tool 100 by the bias of the springs 130. The distal ends of lugs 120 can then engage the slots 58 on the hanger's flange 50 as the tool 100 is rotated an additional amount once the triggers 125 have been triggered.

Instead of having to manually align the lugs 120 of the running tool 100 to a custom matching feature on a load shoulder of a hanger, this running tool 100 automatically deploys the lugs 120 to engage the slots or flutes 58 on the load shoulder 56 of the hanger 50 as the running threads 55, 115 of the tool 100 and hanger 50 are being made up together.

This is done by timing the position of triggers 125 in the inner bore of the running tool 100 to the length of the neck 54 of the mandrel hanger 50. When the neck 54 of the hanger 50 pushes the pins 160 of the triggers 125 out of the way, a latching mechanism of the trigger 125 releases the spring-loaded tapered lugs 120 to allow them to extend. Once they extend, the shifted lugs 120 insert themselves into the slots 58 of the hanger's shoulder 56 within a quarter of a turn or less. The tapered ends 122 of the lugs 120 permit them to retract when they strike the sides of the slots 58 when the tool 100 is rotated in the disengagement direction automatically releasing the hanger 50 from the tool 100.

The shifted lugs 120 engage in the slots 58 with clock edges 123 of the lugs 120 stopping against the clock edges of the slots 58. This prevents further rotation of the running tool 100 on the casing hanger 50 so that tightening of the threading ceases.

The running tool 100 can now move the tubing string (60) axially in the wellbore (10) and can rotate the tubing string (60) radially in the first (clockwise) direction in the wellbore (10). This allows the running tool 100 to manipulate the hanger 50 and connected tubing string (60) during running and cementing operations. As noted previously, the ability to rotate the tubing string (60) in addition to movement up and down can help distribute the cement uniformly.

Once operations are complete, the running tool 100 can be unconnected from the hanger 50 by unthreading the internal thread 115 in a second, opposite direction on the external thread 55 of the hanger 50. A clean disengagement can be made from the hanger 50 because the running threads 55, 115 have not been over-torqued. During the rotation, the lugs 120 ratchet out of the slots 58 on the hanger 50 by the chamfered or tapered edge 122 riding along the counter edge of the slots 58. Eventually, the unthreading is complete, and the running tool 100 can be retrieved.

In some operations, the running tool 100 may be used to run the liner 60 and head 50 downhole, but the running tool 100 may be retrieved and rerun downhole. The tool 100 can be unthreaded as noted. If reconnection is then needed, the running tool 100 can be reset at surface (i.e., the triggers 125 and catches 128 can be reset to hold the lugs 120 in the retracted condition) and run back downhole. Threading can then be made by rotating the running tool 100 in the first direction until the lugs 120 are released and engage the hanger's slots 58.

Figure 4C:
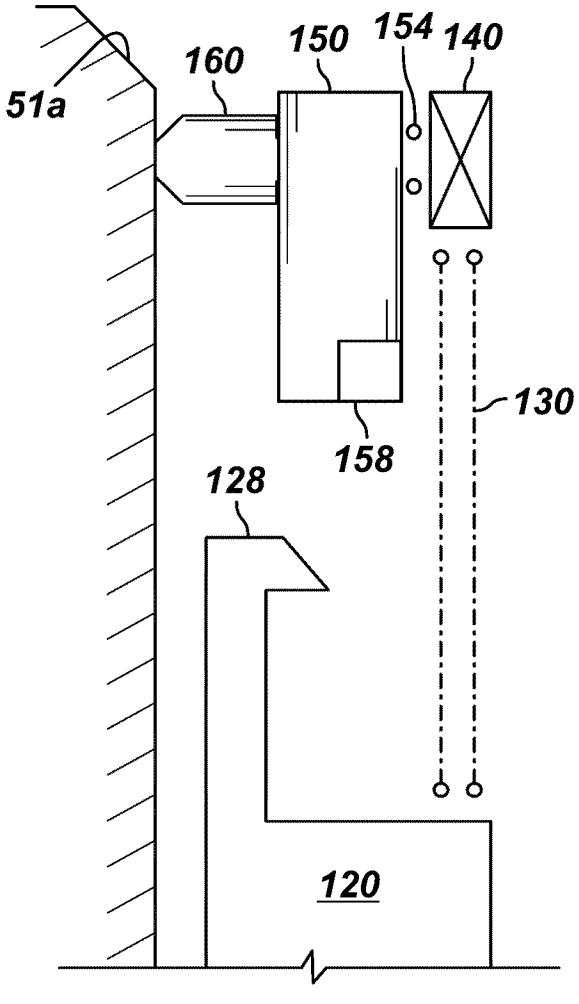
FIGS. 4A-4C diagrams a trigger and catch arrangement for holding and releasing a lug on the running tool of the presented disclosure.
Figure 4B:
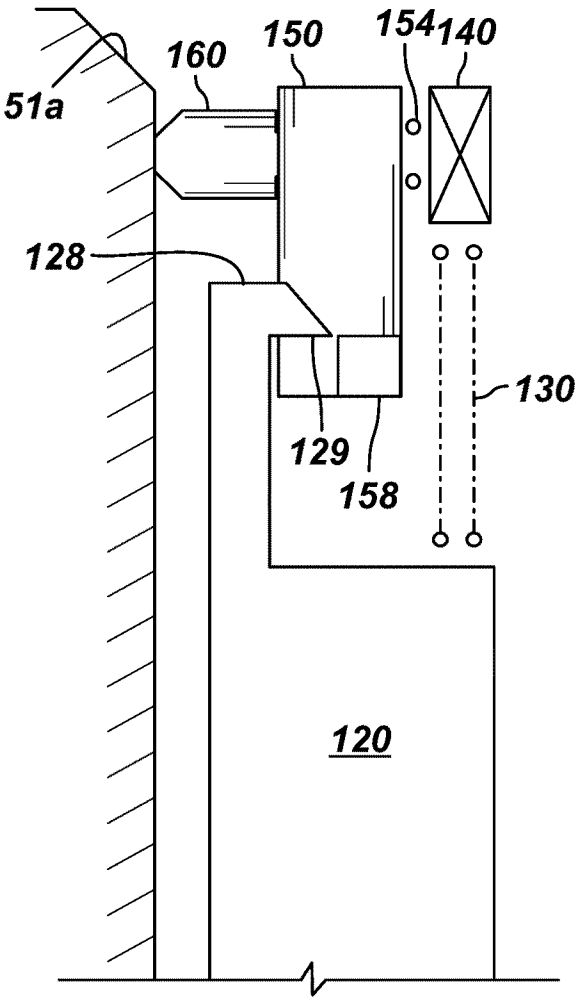
Figure 4A:
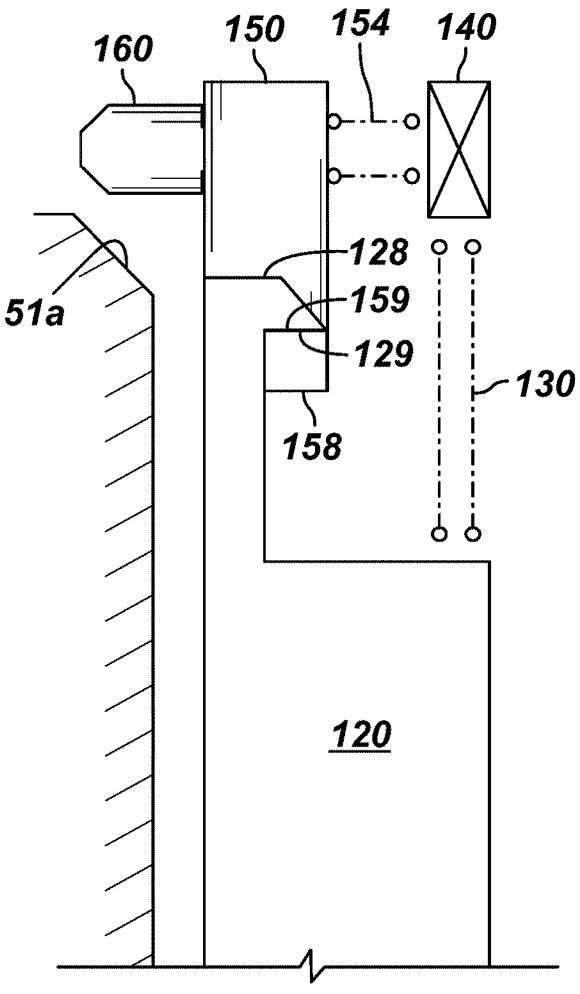

Details of the trigger 125 and catch 128 are diagrammatically shown in FIGS. 4A-4C, which show the triggering and release of a lug 120 during connection of the running tool 100 and the hanger 50.

The catch 128 has a first surface 129 (i.e., downward facing shoulder) disposed on the lug 120. The button 150 of the trigger 125 includes a portion 158 having a second surface 159 (i.e., upward facing shoulder) opposite to the first surface 129. When the trigger 125 is in the first condition holding the lug 120 retracted as shown in FIG. 4A, the second surface 159 of the button 150 is in opposed relation to the first surface 129 of the catch 128. When the trigger 125 is in the second condition releasing the lug 120 to extend as shown in FIGS. 4B-4C, the second surface 159 of the button 150 in the second condition is in unopposed relation to the first surface 129 of the catch 128.

The button 150 is disposed in the pocket (117 of the body 110. As shown, a spring 154 is disposed between button 150 and the body 110 and biases the pin 160 toward the bore (114) through the port (116) in the side of the body (110). For example, a plate 140 can affix externally to the body 110 to hold the button 150 and the spring 154 in the pocket (117). The compression spring 130 is disposed between a shoulder of the plate 140 and a proximal end of the lug 120.

During the threading as shown in FIG. 4B, for example, the pin 160 of the trigger 125 exposed in the bore (114) of the running tool 100 eventually engages on the end 51*a* of the hanger 50. The button 150 of the at least one trigger 125 shifts away from the catch 128 in response to the engagement with the pin 160, releasing the catch 128 from the button 150 as shown in FIG. 4C. The spring 130 pushes the released lug 120 along the longitudinal pocket (117) so the distal end extends beyond lower edge of the running tool 100.

Although disclosed in relation to rotating a casing string during cementing operations, it will be appreciated that the teachings of the present disclosure can apply equally well to rotating any suitable tubular string.

To conserve space and motion, the lugs 120 preferably extend from the end 101*b* of the tool 100 to engage the slots 58 of the hanger 50, but other arrangements can be used. For example, the lugs 120 can be biased to extend inwardly in the bore 112 of the running tool 100 and can engage radial slots (not shown) in the side of the hanger's neck 54.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A tool for running a hanger and a tubing string, the hanger having upper and lower ends and defining a first bore therethrough, the lower end connected to the tubing string, the upper end having a first thread disposed thereabout, the hanger defining at least one first slot, the tool comprising:

a tool body having first and second ends and defining a second bore therethrough, the second bore defining a second thread thereabout, the second thread configured to thread onto the first thread in a first direction;

at least one lug disposed on the tool body, the at least one lug having a catch;

at least one trigger disposed in the tool body and movable between first and second conditions, the at least one trigger in the first condition engaged with the catch and being engageable with the hanger, the at least one trigger in the second condition releasing the catch; and at least one biasing element biasing the at least one lug released from the catch toward an extended condition, the at least one lug in the extended condition being engageable with the at least one slot in the hanger.

2. The tool of claim 1, wherein the at least one lug comprises a first shoulder and a second shoulder, the first shoulder being engageable in the first direction with a first side of the at least one slot, the second shoulder being ratchetable along the second side of the at least one slot.

3. The tool of claim 2, wherein the second thread of the body threads in the first direction onto the first thread of the hanger and unthreads in a second, opposite direction from the first thread.

4. The tool of claim 1, wherein the at least one lug comprises a distal end, the distal end in the extended condition extending beyond the second end of the hanger and being engageable with the at least one slot in a flange disposed externally about the casing hanger.

5. The tool of claim 1, wherein the at least one trigger comprises a first portion and a second portion, the first portion exposed internally to the second bore through a port in a side of the body, the first portion engageable with the hanger, the second portion engageable with the catch and being releasable therefrom in response to the engagement of the first portion with the hanger.

6. The tool of claim 5, wherein the catch comprise a first surface disposed on the at least one lug; and wherein the second portion of the at least one trigger comprises a second surface opposite to the first surface, the first surface with the at least one trigger in the first condition disposed in opposed relation to the second surface, the first surface with the at least one trigger disposed in the second condition in unopposed relation to the second surface.

7. The tool of claim 5, wherein the at least one trigger comprises:

a button having the first and second portions and disposed in a pocket of the body; and a spring disposed between the button and the body and biasing the first portion toward the second bore through the port in the side of the body.

8. The tool of claim 7, wherein the first portion of the button comprises a pin disposed in the port in the side of the body.

9. The tool of claim 1, wherein the at least one biasing element comprises a compression spring disposed between a shoulder of the body and a proximal end of the at least one lug.

10. The tool of claim 1, wherein the tool body defines at least one pocket outside the tool body, the at least one pocket having the at least one lug recessed therein.

11. The tool of claim 1, wherein the at least one lug defines a channel along the at least one lug; and wherein the tool body comprises a retainer disposed in the channel and retaining the at least one lug in the at least one pocket.

12. The tool of claim 1, wherein the tool body comprises a first material; and wherein the at least one lug comprises a second material different from the first material.

13. An apparatus run on a running string for cementing a tubing string in a wellbore, the apparatus comprising:

a hanger having upper and lower ends and defining a first bore therethrough, the lower end connected to the tubing string, the upper end having a first thread disposed thereabout, the hanger defining at least one first slot;

a running tool having first and second ends and defining a second bore therethrough, the first end configured to connect to the running string, the second bore defining a second thread thereabout, the second thread configured to thread onto the first thread in a first direction;

at least one lug disposed on the running tool, the at least one lug having a catch;

at least one trigger disposed in the running tool and movable between first and second conditions, the at least one trigger in the first condition engaged with the catch and being engageable with the hanger, the at least one trigger in the second condition releasing the catch; and at least one biasing element biasing the at least one lug released from the catch toward an extended condition, the at least one lug in the extended condition being engageable with the at least one slot in the hanger.

14. A method of running a tubing string and a hanger in a wellbore, the hanger having a first thread, the method comprising:

threading a second thread on the running tool in a first direction on the first thread of the hanger;

engaging, during the threading, at least one trigger in the running tool on a portion of the hanger;

releasing at least one catch in response to the engagement of the at least one trigger;

shifting at least one lug from a retracted condition to an extended condition on the running tool in response to the release of the at least one catch; and engaging the at least one shifted lug in the first direction in at least one slot on the hanger.

15. The method of claim 14, further comprising:

unthreading the second thread in a second, opposite direction off of the first thread of the hanger; and ratcheting, during the unthreading, the at least one lug out of the at least one slot on the second hanger.

16. The method of claim 14, further comprising:

moving the tubing string axially in the wellbore with the running tool; and rotating the tubing string radially in the first direction in the wellbore with the running tool.

17. The method of claim 14, wherein engaging, during the threading, the at least one trigger in the running tool on the hanger comprises engaging an internal portion of the at least one trigger exposed in a bore of the running tool on the hanger.

18. The method of claim 17, wherein releasing the at least one catch in response to the engagement of the at least one trigger comprises shifting a second portion of the at least one trigger away from the catch in response to the engagement with the internal portion.

19. The method of claim 14, wherein shifting the at least one lug from the retracted condition to the extended condition on the running tool in response to the release of the at least one catch comprises biasing the at least one lug to the extended condition with a distal end of the at least one lug extending beyond an edge of the running tool.

20. The method of claim 14, wherein engaging the at least one shifted lug in the first direction in the at least one slot on the hanger comprises stopping a second edge of the at least one shifted lug against a first edge of the at least one slot.

* * * * *